US005214234A

United States Patent [19]

Divecha et al.

[11] Patent Number: 5,214,234

[45] Date of Patent: May 25, 1993

[54] COMPOSITE REINFORCED GUN BARRELS

[75] Inventors: Amarnath P. Divecha, Falls Church; Subhash D. Karmarkar, Great Falls, both of Va.; Scott M. Hoover, Burtonsville, Md.; William A. Ferrando, Arlington, Va.

[73] Assignee: The United States of America as represented by the Secretary of the Navy, Washington, D.C.

[21] Appl. No.: 914,668

[22] Filed: Jul. 17, 1992

[51] Int. Cl.[5] ..... F41A 21/02

[52] U.S. Cl. ..... 89/16; 42/76.02

[58] Field of Search ..... 89/16; 42/76.02

[56] References Cited

U.S. PATENT DOCUMENTS

| | | | |
|---|---|---|---|
| 3,828,417 | 8/1974 | Divecha | 29/419 |
| 4,061,433 | 12/1977 | Chave | 89/16 |
| 4,485,721 | 12/1984 | Shankhla et al. | 89/16 |
| 4,911,060 | 3/1990 | Greenspan et al. | 89/16 |

*Primary Examiner*—David H. Brown

*Attorney, Agent, or Firm*—Roger D. Johnson

[57] ABSTRACT

A composite reinforced gun barrel with a composite of a titanium, nickel, or FeCrAlY alloy matrix reinforced with round filaments or rectangular ribbons made of molybdenum or tungsten. The composite layer may be bonded directly onto the barrel or it may be bonded to a steel jacket which can then be heat shrunk onto an existing gun barrel.

14 Claims, 5 Drawing Sheets

COMPOSITE REINFORCED GUN BARRELS

BACKGROUND OF THE INVENTION

This invention relates to gun barrels and more particularly to gun barrels for automatic weapons.

Permanent barrel distortion or bending in the M60 E3 machine gun is attributed to two causes. The first cause, that of thermal mismatch between barrel and gas cylinder and other cause is permanent bending due to barrel whip. The barrel whip is perceived to arise from moments or torques placed on the barrel during gun firing. The present barrel is a thin steel barrel and during the operation the temperature reaches some 1200° F. The yield strength of the barrel steel is estimated to be 50,000 PSI at room temperature and 0.1% offset yield strength at 1300° F. is less than 10,000 PSI. Under these conditions, the barrel bends during service. To alleviate this problem, industry began to design a thick barrel which increased its weight almost three fold, resulting in a large weight penalty.

SUMMARY OF THE INVENTION

According, an object of this invention is to provide a new reinforced gun barrel.

Another object of this invention is to provide a new gun barrel having great strength at high temperatures than conventional gun barrels.

A further object of this invention is to provide new composite gun barrels that are easier and less expensive to manufacture.

These and other objects of this invention are accomplished by providing:

A steel gun barrel that is reinforced with a composite of a nickel, titanium, or FeCrAlY alloy matrix with tungsten or molybdenum reinforcing elements.

In one variation, the composite is formed between an inner and an outer steel jacket. The inner diameter of the inner steel jacket is selected so that the composite structure can be heat shrunk onto a gun barrel.

The composite reinforced gun barrels or heat shrinkable gun barrel reinforcing composites are prepared from nickel, titanium, or FeCrAlY alloy clad tungsten or molybdenum reinforcing elements (round filaments, rectangular ribbons, etc.) using explosive bonding procedures.

BRIEF DESCRIPTION OF THE DRAWINGS

A more complete appreciation of this invention and many of the attendant advantages thereof will be readily appreciated as the same becomes better understood by reference to the following detailed description when considered in connection with the accompanying drawings, wherein.

None of these figures are drawn to scale. Ribbons and filaments are not shown in the actual numbers in which they occur in the composites.

DETAILED DESCRIPTION OF THE PREFERRED EMBODIMENT

In the present invention, tungsten ribbon or filament reinforced metal alloy matrix composites are used to reinforce the steel barrels of automatic weapons. Conventional steel barrels slump or bend when they are heated up by the rapid fire of the automatic weapons. As a result they must be replaced frequently. The composite reinforced gun or rifled barrels of this invention have substantially greater high temperature strengths and therefore longer useful lifes.

The basic element in producing the composite structure is a matrix metal clad tungsten rectangular ribbon or round filament. These matrix metal clad tungsten ribbons or filaments are prepared according to the methods taught in U.S. Pat. No. 3,828,417, titled "Method for Fabricating Composite Material Reinforced by Uniformly Spaced Filaments", which issued on Aug. 13, 1974 to Amarnath P. Divecha, and which is herein incorporated in its entirety by reference. First, a long, continuous tungsten ribbon or filament is wrapped with a thin ribbon of the matrix material so that there are no gaps in the wrap. For example, a round tungsten filament (0.015 inches in diameter) was wrapped or encapsulated by winding a FeCrAlY alloy ribbon (0.008 inches thick and 0.030 inches wide) using a winding machine as disclosed in U.S. Pat. No. 3,828,417, supra. (The composition of the FeCrAlY alloy by weight percent is: Cr, 22.0; Al, 5.0; Y, 0.08; with the balance being Fe.) The continuous, FeCrAlY alloy encapsulated tungsten filament was cold swaged to smooth out the unevenness of the winding and produce a smooth FeCrAlY cladding on the tungsten filament. The claded tungsten filament was then cleaned to remove any dirt or oil.

Figure 5:
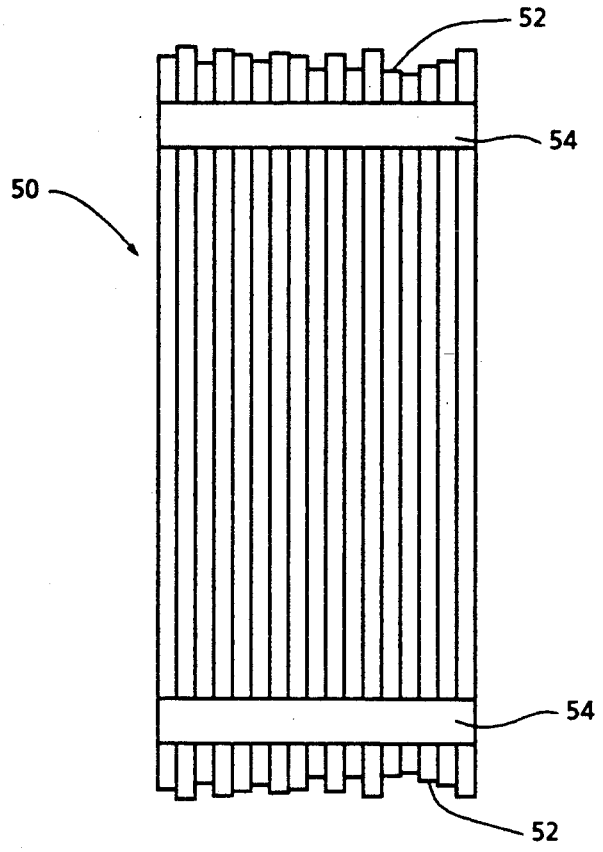
FIG. 5 represents a typical mat of matrix metal clad tungsten filaments used in the processes of this invention.
Figure 6A:
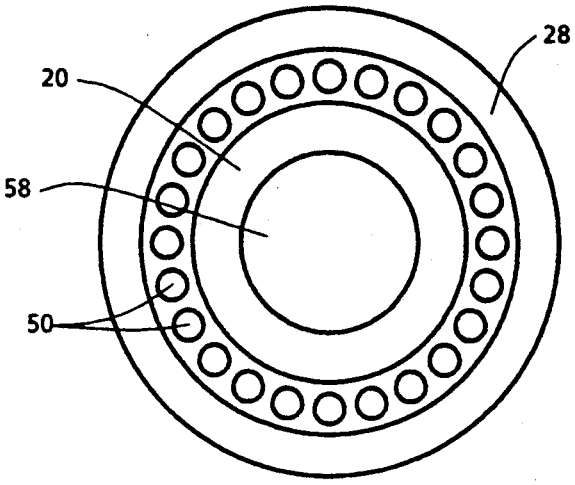
FIGS. 6A and 6B are schematic drawings of the end (6A) and side (6B) views of the precursor structure for a typical composite reinforced gun barrel prior to the explosive bonding step.
Figure 6B:
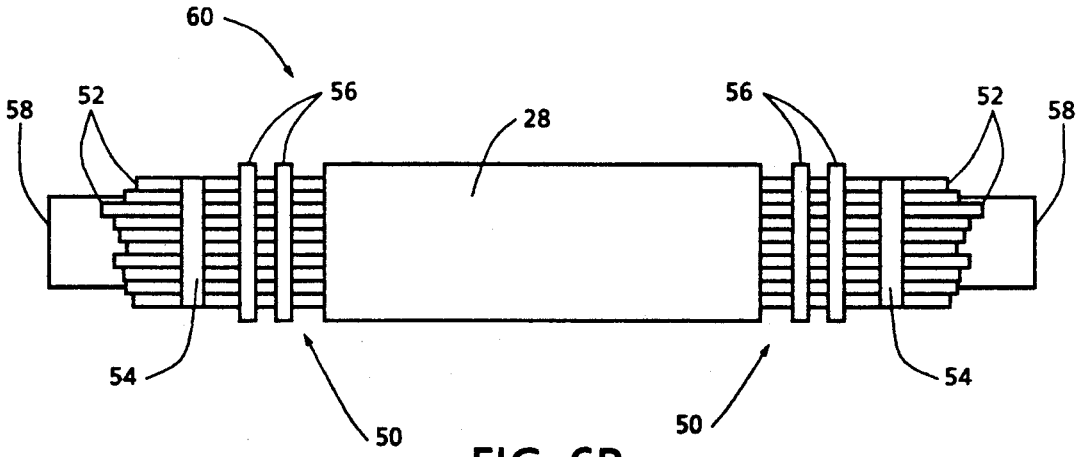

Next the continuous FeCrAlY alloy-claded round tungsten filaments were cut into segments of a desired length (e.g., 7 inches in the examples). Referring to FIG. 5, the FeCrAlY alloy claded tungsten filament segments 52 were placed side by side to form a rectangular mat 50. The mat 50 was held together by tape 54 at the ends of the filaments 52. The resulting mat 50 is flexible, similar to a bamboo mat. Referring to FIG. 6A (cross section) and FIG. 6B side view), the FeCrAlY alloy clad tungsten fiber mat 50 is wrapped around the barrel 20 and held into place by metal bands 56 to enable the insertion of the wrapped barrel (20 and 50) into the outer steel jacket 28. There was a 0.010 inch radial gap between the outside surface of the FeCrAlY alloy clad tungsten filament mat 50 and the inside surface of the outer steel jacket 28. This gap is necessary for a good explosive bond to be achieved. If the gap is too small no bonding or poor bonding will occur. If the gap is too large the resulting composite reinforcing structure will be misaligned. After the barrel 20 and FeCrAlY alloy clad tungsten mat 50 are in place in the outer steel jacket 28, the metal bands 56 are removed. However, the tape strips 54 are left on the clad tungsten fibers 52 to maintain the structure of the fiber mat 50. The resulting structure comprising the barrel 20, FeCrAlY alloy clad tungsten fiber mat 50, and the outer steel jacket 28 is referred to as the composite reinforced gun barrel precursor 60 in FIG. 7 and the accompanying discussion. Note that the tape strips 54 are positioned on those portions of the FeCrAlY alloy clad tungsten fiber mat 50 that are not enclosed in the outside steel jacket 28. As a result, the tape 54 does not interfere with the formation of the composite structure by explosive bonding. Also shown in FIG. 6A is a steel core 58 which is inserted into the barrel 20 to provide support during the explosive bonding step. The steel core 58 is lubricated with graphite so that it can be easily removed from the barrel 20 after the explosive bonding step.

Figure 7:
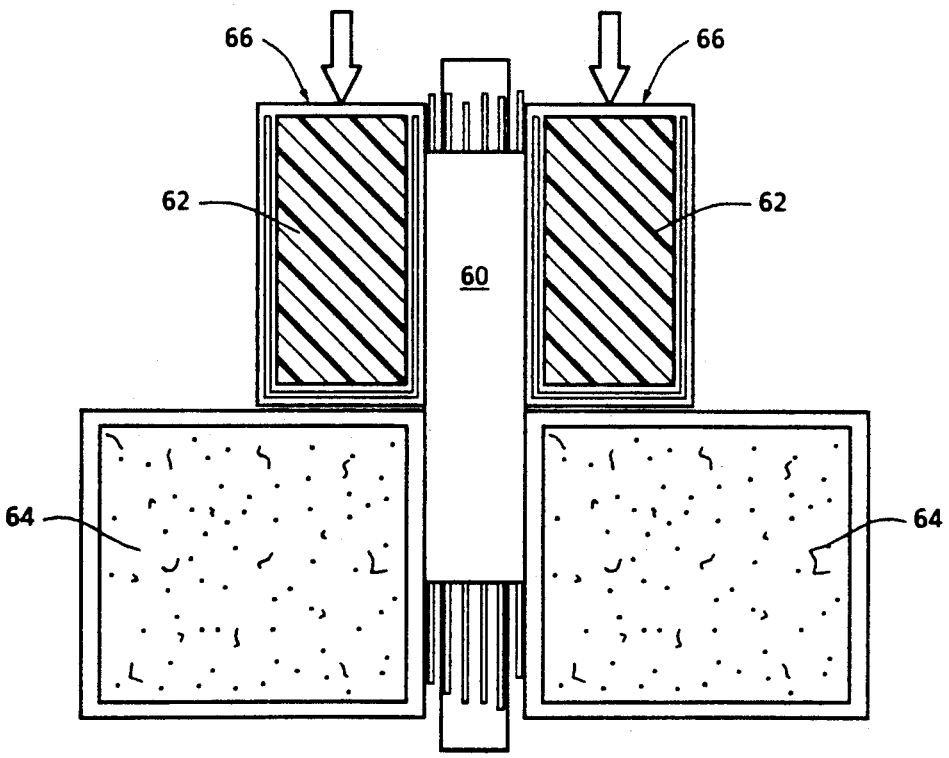
FIG. 7 is a schematic drawing of the typical set up for the explosive bonding step.

In the last step of the process, the components are explosively bonded together using conventional explosive bonding techniques. FIG. 7 is a schematic cross-section representing a conventional explosive bonding set up. The composite reinforced gun barrel precursor 60 with cylindrical steel core 58 is placed in an annular ring of sand 64 and an annular ring of explosive 62. The explosive 62 is initiated at surface 66 and the detonation front travels in the direction of the arrows. In the examples, enough explosive was used to produce a pressure of 16.82 Kbar with a pulse duration of 35.0 microseconds. The optimum pressure for bonding will vary with the materials used. If too little pressure (explosive) is used the bonding will be poor. However, if too much pressure (explosive) is used the resulting structure will be deformed. Techniques for adjusting and optimizing the pressure are common and well understood in the explosive bonding art.

Figure 1:
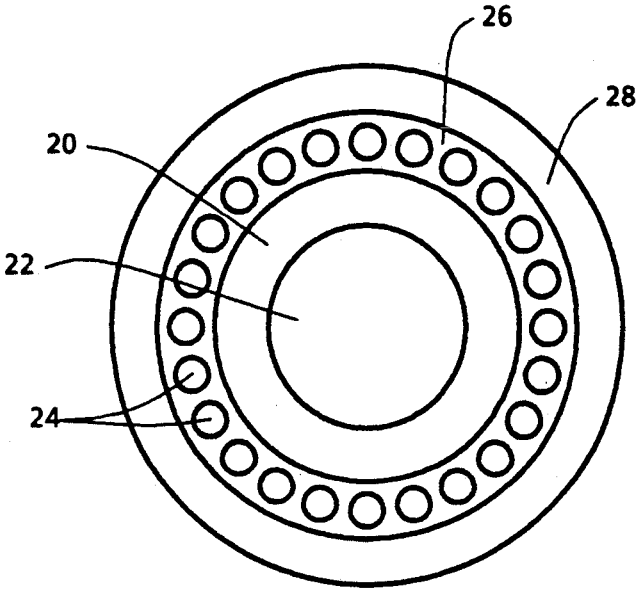
FIG. 1 is a schematic cross-sectional drawing representing a gun barrel reinforced with a composite layer of round tungsten filaments in a metal matrix.

FIG. 1 is cross-sectional schematic representing the composite reinforce barrel produced (in the first example) by wrapping the barrel 20 in one layer of the FeCrAlY alloy clad tungsten round filament mat 50 ( FIG. 6A). The FeCrAlY alloy cladings are explosively bonded together to form a single FeCrAlY alloy matrix 26. The FeCrAlY alloy matrix is also explosively bonded to the steel barrel 20, the outside steel jacket 28, as well as the round tungsten filaments 24. The FeCrAlY alloy matrix 26 separates the tungsten filaments 24 from each other as well as from the steel barrel 20 and from the outer steel jacket 28. Also shown is the hole 22 in the barrel 20.

Figure 2:
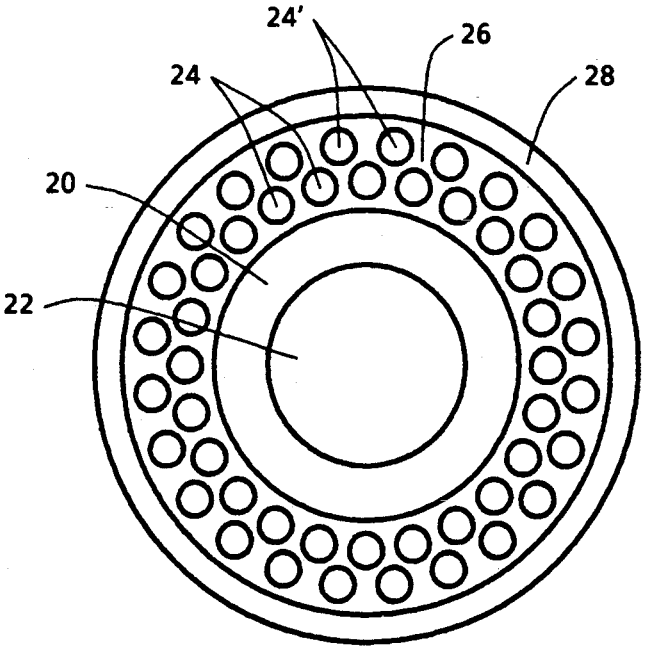
FIG. 2 is a cross-sectional schematic drawing representing a gun barrel reinforced with a composite layer of round tungsten filaments in a metal matrix, wherein the composite layer is double that of FIG. 1.

FIG. 2 is a cross-sectional schematic representing the composite reinforced barrel produced in a second example by wrapping the barrel 20 in two layers of the FeCrAlY alloy clad round tungsten round filament mat 50 (FIG. 6A). The remainder of the process was the same as in the first example. The product composite reinforced barrel (FIG. 2) the same as that produced in the first example (FIG. 1) except that the composite layer is thicker and has a second row of round tungsten filament 24' offset from the first row of filaments 24 near the steel barrel 20. The FeCrAlY alloy matrix 26 separates the tungsten filaments 24 and 24' from each other as well as from the steel barrel 20 and from the outer steel jacket 28.

Figure 3:
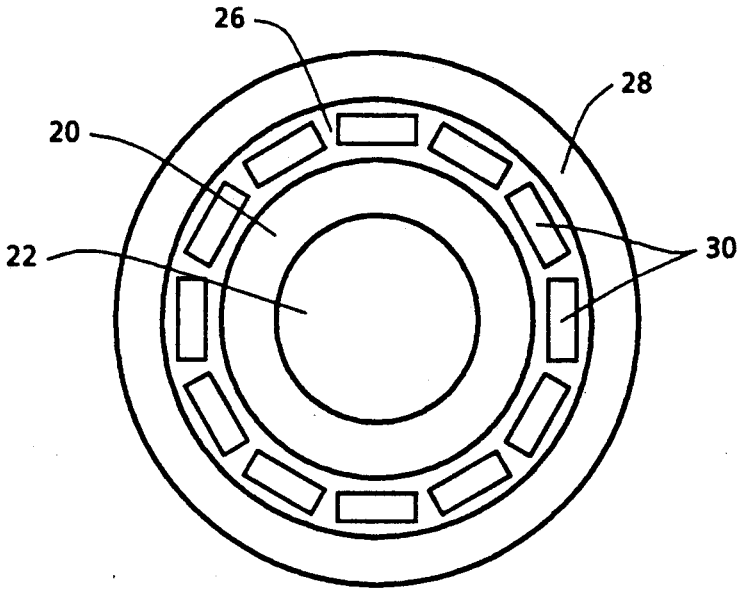
FIG. 3 is a cross-sectional schematic drawing representing a gun barrel reinforced with a composite layer of rectangular tungsten ribbons in a metal matrix.

A third example differs from the first example only in that a rectangular tungsten ribbon (0.008 inches thick and 0.030" inches wide) was used in place of the 0.015 inch diameter round tungsten filament. Otherwise, the FeCrAlY alloy clading, mat formation, and explosive bonding steps were the same. FIG. 3 is a cross-sectional schematic representing the composite reinforced barrel produced in this third example. Shown is the steel barrel 20, the hole 22 in the barrel 20, the single FeCrAlY alloy matrix 26, the rectangular tungsten ribbons 30, and the outer steel jacket 28. Again, the single FeCrAlY alloy matrix 26 is formed by the explosive bonding of the FeCrAlY alloy cladings together. The FeCrAlY alloy matrix is also explosive bonded to the tungsten ribbons 30, steel barrel 20, and outer steel jacket 28. The FeCrAlY alloy matrix 26 separates the rectangular tungsten ribbons 30 from each other as well as from the steel barrel 20 and from the outer steel jacket 28. In the specific embodiment shown in FIG. 3, the largest surface of each tungsten ribbon 30 faces the long axis of the steel barrel 20. The long axis runs down the length of the steel barrel 20 at the center of the hole 22 in the barrel 20.

Figure 4:
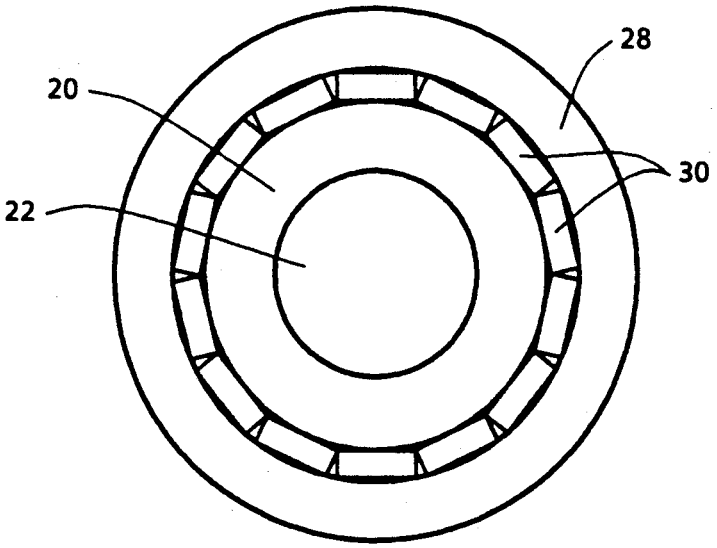
FIG. 4 is a cross-sectional drawing representing a gun barrel that is reinforced with a layer a layer of unclad rectangular tungsten ribbons.

In a fourth example, a reinforcing mat 50 is formed from the unclad tungsten ribbons 30 placed side by side with no gaps between, wrapped around the steel barrel 20, and then inserted into the outer steel jacket 28. Explosive bonding produced the structure represented by FIG. 4, comprising the tungsten ribbons 30 which are explosively bonded to both the steel barrel 20 and the outer steel jacket 28.

Figure 8:
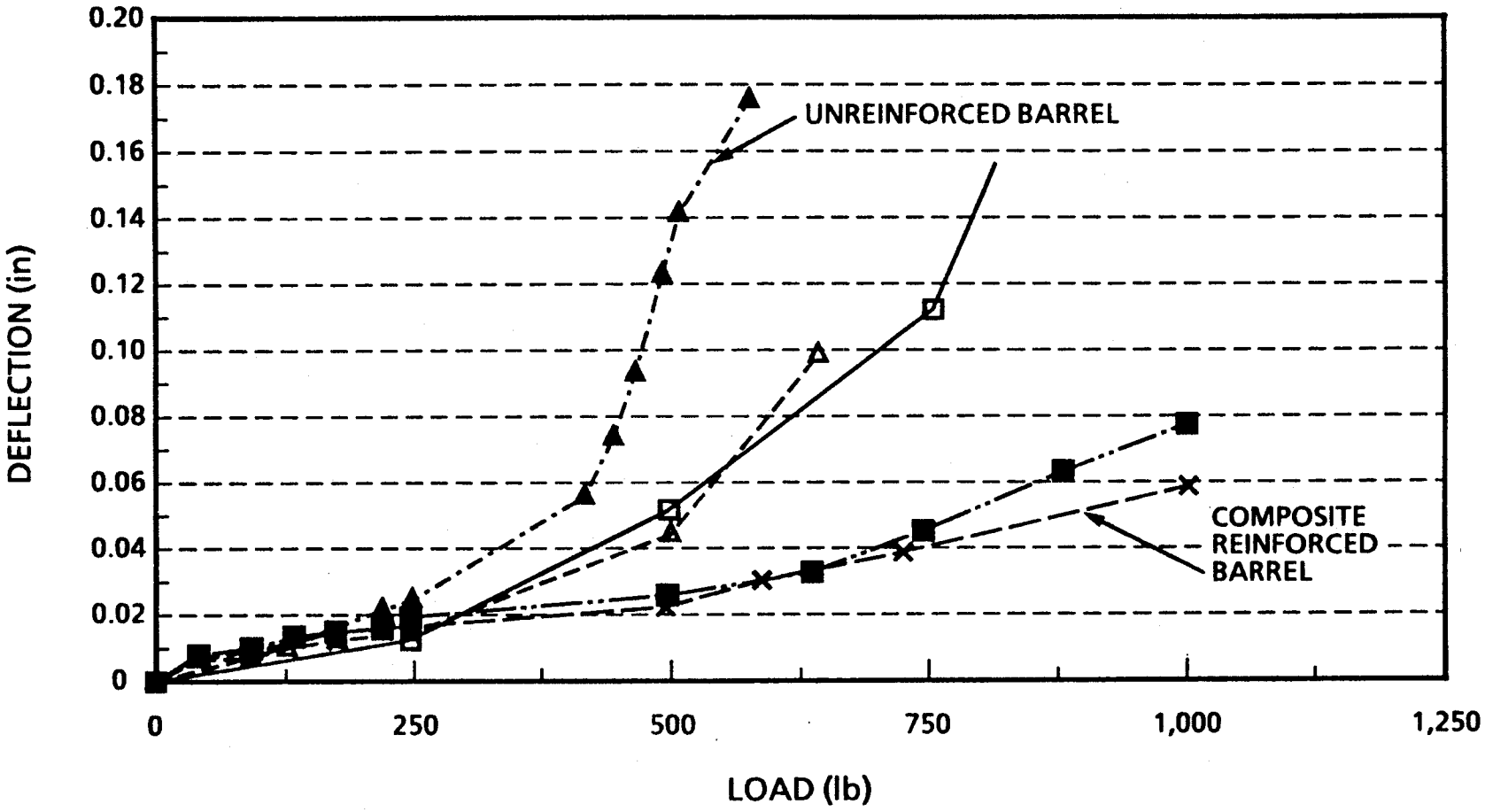
FIG. 8 is a plot of barrel deflection versus load at 1300° F. for the various composite reinforced gun barrels as well as the unreinforced barrel (as a control).

Each of the 7 inch barrels produced in examples 1 through 4 were heated to 1300° F. and an increasing load was applied. FIG. 8 presents a plot of barrel deflection versus load for each of the barrels. The unreinforced barrel is represented by solid triangles (Δ). The single layer of FeCrAlY alloy matrix with round filaments of tungsten produced in the first example is represented by the open squares (□). As can be seen, this composite reinforcement provides substantial improved performance over the unreinforced barrel. Similarly the FeCrAlY alloy matrix with rectangular tungsten ribbons, produced in the third example, represented by the open triangles (Δ), provides substantially greater high temperature strength. However, the greatest high temperature strength was achieved in the double layer FeCrAlY alloy matrix with round tungsten filaments, represented by the exes (X), which was produced in the second example. This is the preferred embodiment. Addition of a third layer will just add weight without substantially improving the high temperature strength. Finally, the barrel reinforced with unclad tungsten ribbons (fourth example), represented by solid squares (□), also provides excellent resistance to bending at high temperatures. However, the tungsten ribbons 30 are explosive bonded directly to the steel barrel 20 and to the outer steel case 28 (see FIG. 4). Tungsten in contact with steel at elevated temperatures (e.g., ~1200° F.) oxidizes, thus weakening the bonds and the composite structure.

An important variation of this invention is achieved by replacing a tubular steel barrel 20 with a thin tubular steel inner jacket in the above processes. The inside diameter of the steel inner jacket is selected so that the resulting composite structure can be heat shrunk over the gun barrel. Heat shrink fitting is achieved by chilling the gun barrel (e.g., liquid nitrogen), so that its outer diameter contracts and heating the composite structure so that its inner diameter expands, and then sliding the composite structure over the barrel. When the barrel warms up to and the composite structure cools down to room temperature, a strong physical bond is achieved. These composite structure can be produced in long lengths and then cut to size as needed.

The matrix material is preferably nickel, titanium, or FeCrAlY alloy, with FeCrAlY alloy being more preferred.

The reinforcing elements are preferably made from tungsten or molybdenum, with tungsten being the more preferred material.

Round filaments and rectangular ribbons are the preferred shapes for the reinforcing elements. However, long reinforcing elements having other shaped cross-sections such as triangular, hexagonal, eleptical, etc., may also be used.

Numerous other modifications and variations of the present invention are possible in light of the foregoing teachings. It is therefore to be understood that within the scope of the appended claims the invention may be practiced otherwise than as specifically described.

We claim:

1. A composite reinforced gun barrel comprising:

A. a steel gun barrel;

B. a composite material comprising (1) a matrix material that is nickel, titanium, or FeCrAlY alloy, and (2) reinforcing elements that are round tungsten filaments, rectangular tungsten ribbons, round molybdenum filaments, or rectangular molybdenum ribbons, wherein the reinforcing elements are straight and parallel to the long axis of the gun barrel and run the length of the composite material, and C. an outer steel jacket;

wherein the composite material covers the outer surface of the steel gun barrel and the outer steel jacket covers the outer surface of the composite material; and wherein the matrix material is strongly bonded to the outer surface of the steel gun barrel, to the inner surface of the outer steel jacket, and to the reinforcing elements, and wherein the matrix material separates the reinforcing elements from each other and from the steel gun barrel and from the outside steel jacket.

2. The composite reinforced gun barrel of claim 1 wherein the matrix material is FeCrAlY alloy.

3. The composite reinforced gun barrel of claim 1 wherein the reinforcing elements are rectangular tungsten ribbons.

4. The composite reinforced gun barrel of claim 3 wherein a single row of rectangular tungsten ribbons is used and wherein the largest surface of each ribbon faces the long axis of the steel barrel.

5. The composite reinforced gun barrel of claim 1 wherein the reinforcing elements are round tungsten filaments.

6. The composite reinforced gun barrel of claim 5 wherein a single row of round tungsten filaments is used.

7. The composite reinforce gun barrel of claim 5 wherein two rows of round tungsten filaments is used and wherein the filaments in the second row are offset from filaments in the first row.

8. A composite structure for reinforcing a gun barrel comprising:

A. An inner steel jacket having an inner diameter such that the composite structure can be heat shrunk over the barrel;

B. A composite material comprising (1) a matrix material that is nickel, titanium, or FeCrAlY alloy, and (2) reinforcing elements that are round tungsten filaments, rectangular tungsten ribbons, round molybdenum filaments, and rectangular molybdenum ribbons, wherein the reinforcing elements are straight and parallel to the long axis of the inner steel jacket and run the length of the composite material, and C. an outer steel jacket;

wherein the composite material covers the outer surface of the inner steel jacket and the outer steel jacket covers the outer surface of the composite material; and wherein the matrix material is strongly bonded to the outer surface of the inner steel jacket, to the inner surface of the outer steel jacket, and to the reinforcing elements, and wherein the matrix material separates the reinforcing elements from each other and from the inner steel jacket and from the outside steel jacket.

9. The composite structure of claim 8 wherein the matrix material is FeCrAlY alloy.

10. The composite structure of claim 8 wherein the reinforcing elements are rectangular tungsten ribbons.

11. The composite structure of claim 10 wherein a single row of rectangular tungsten ribbons is used and wherein the longest surface of each ribbon faces the long axis of the inner steel jacket.

12. The composite structure of claim 8 wherein the reinforcing elements are round tungsten filaments.

13. The composite structure of claim 12 wherein a single row of round tungsten filaments is used.

14. The composite structure of claim 12 wherein two rows of round tungsten filaments is used and wherein the filaments in the second row are offset from filaments in the first row.

* * * * *